US005090631A

United States Patent [19]

Wark

[11] Patent Number: 5,090,631

[45] Date of Patent: Feb. 25, 1992

[54] AIR FLOW RATE CONTROL DEVICE FOR PULVERIZER VANE WHEEL

[76] Inventor: Rickey E. Wark, 2217 Lake Angelus Rd., Pontiac, Mich. 48055

[21] Appl. No.: 597,856

[22] Filed: Oct. 15, 1990

[51] Int. Cl.[5] ..... B02C 15/00

[52] U.S. Cl. ..... 241/119

[58] Field of Search ..... 241/57, 55, 60, 61, 241/117-121

[56] References Cited

U.S. PATENT DOCUMENTS 4,598,872 7/1986 Henne et al. ..... 241/119 X 4,907,751 3/1990 Wark et al. ..... 241/119

FOREIGN PATENT DOCUMENTS 264156 1/1989 German Democratic Rep. ..... 241/119

*Primary Examiner*—Mark Rosenbaum

*Attorney, Agent, or Firm*—Krass & Young

[57] ABSTRACT

An air flow rate control device for a rotating or stationary vane throat in a bowl mill pulverizer. The air flow rate control device comprises an adjustable deflector mounted on the lower surfaces of the pitched vanes to provide varying air flow passage cross sections.

14 Claims, 3 Drawing Sheets

AIR FLOW RATE CONTROL DEVICE FOR PULVERIZER VANE WHEEL

FIELD OF THE INVENTION

This invention relates to coal pulverizers and more particularly to an improved mechanism for controlling air flow rate through the air passages between pitched vanes in the pulverizer throat.

BACKGROUND OF THE INVENTION

Pulverizers such as bowl mills are commonly used to prepare coal for introduction into the combustion chambers of steam generators; representative pulverizers are currently offered for sale by Babcock and Wilcox, Foster-Wheeler and Combustion Engineering. Bowl mill pulverizers typically perform a classification function through the use of a vertical air flow through a "throat" which is made up of a circular arrangement of pitched vanes surrounding the outer periphery of the crushing surface and forming air flow passages between a wind box and the classification area. The vanes are made up of metal plates usually welded to and between inner and outer rings. The vane assembly or "throat" may be stationary or it may be mounted for rotation about a vertical axis.

Air flow rate through the passages formed by the pitched vanes is a function of the effective cross-sectional area of the passages and the pressure head produced by the fans, turbines or other air drive mechanisms. It is desirable to control air flow rate through cross-sectional area adjustment to optimize pulverizer performance.

One prior art mechanism for controlling cross-sectional area and flow rate comprises spacer blocks which are bolted to the inside ring of the vane assembly. The blocks can come in various sizes or may be bolted on top of one another to reduce the size of the air flow passage and the air flow velocity. In this approach the spacer blocks are in the path of particulate matter flow and, therefore, are subject to abrasion and wear. As a consequence, the spacer blocks must be made of a more expensive wear resistant material. Moreover, it is a time consuming and cumbersome job to install and remove the spacer blocks.

An alternative approach to air flow control is disclosed in my U.S. Pat. No. 4,907,751, "Rotating Throat for Coal Pulverizer", issued Mar. 13, 1990. In that patent I disclose the use of slide-on, wear resistant vane liners in the form of metal plates which overlie the upper principal surface of the pitched vanes. Each liner plate has an integral angled portion which rests on the top edge of the vane and partially closes the air flow opening. The vane liners are held in place by means of arcuate over-plates or caps which are bolted to the top surface of the inner portion of the vane/throat assembly. The degree to which the arcuate plates extend over the openings also affects the area of the air flow passage and the air flow rate. Like the spacer blocks, adjustment or change in air passage size can be achieved only by interchanging one set of liners or caps for others of a different size.

SUMMARY OF THE INVENTION

According to the present invention an apparatus is provided modifying the size of the air flow openings between the pitched vanes of a pulverizer throat, which mechanism is out of the main stream of particulate flow and may be made of inexpensive materials.

In general, this is achieved by attaching a deflector device, such as a steel shape, to the undersides of the pitched vanes to reduce at least a portion of the cross-sectional area of each flow passage to a desired degree.

According to a second aspect of the invention, the deflector devices are readily adjustable to the desired degree; moreover adjustment requires neither removal nor interchange of parts.

In general this is achieved through the disposition of hinged deflectors with adjustment mechanisms on the under surfaces of the pitched vanes. In the preferred form the deflectors are simple relatively light-gage steel shapes, the lower edges of which are hinged to the surfaces of the pitched vanes and the upper portions of which are connected to the vane undersurfaces by means of a threaded fastener which permits infinite adjustment in the spacing between the deflector and the undersurface of the associated pitched vane. The passage between vanes may therefore be infinitely adjusted and caused to assume an essentially venturi shape wherein the cross-sectional area is gradually reduced toward the upper portion of the passage such that air flow rate gradually increases from a minimum at the entrance of the passage to a maximum at the exit of the passage.

These and other advantages will be more readily achieved from a reading of the following specification which describes one or more illustrative embodiments of the invention in detail.

IN THE DRAWINGS

DETAILED DESCRIPTION OF AN ILLUSTRATIVE EMBODIMENT

Figure 1:
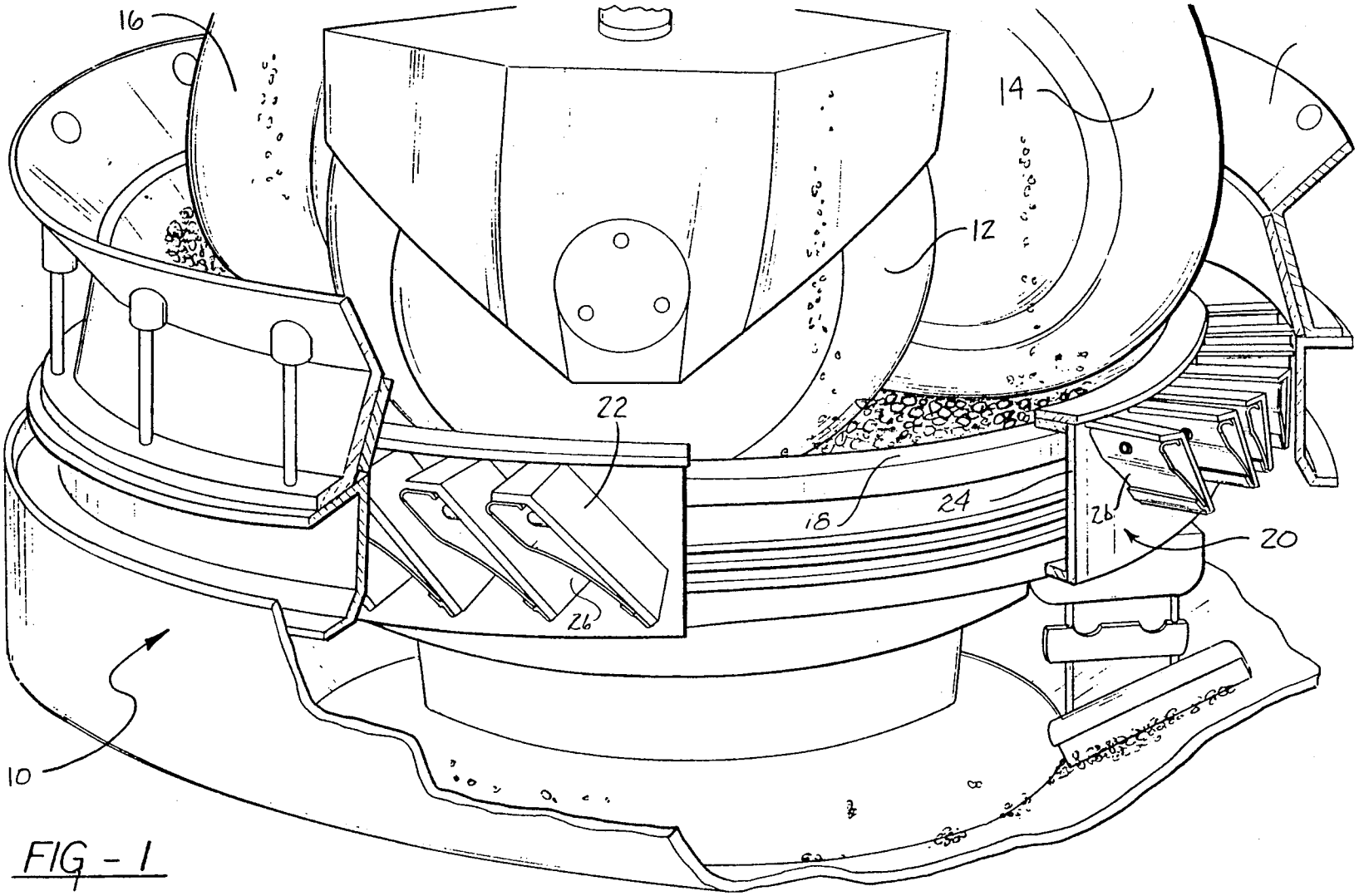
FIG. 1 is a perspective view partly in section of a bowl mill pulverizer utilizing a rotating vane arrangement employing an embodiment of the present invention.
Figure 4:
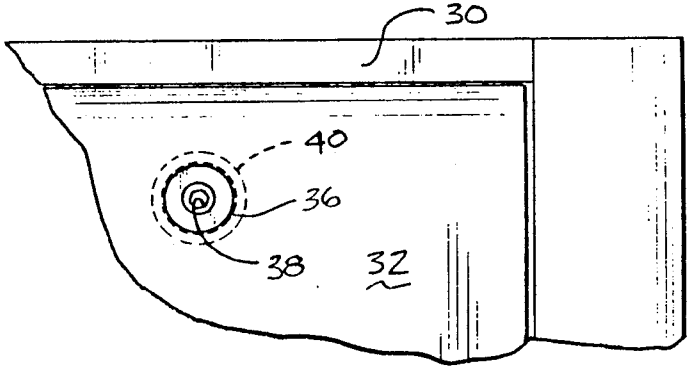
FIG. 4 is a front view of the device of FIG. 3.

Referring first to FIG. 1, a bowl mill type pulverizer 10 comprises grinding wheels 12, 14 and 16 operating to crush coal in a bowl 18. Surrounding the bowl 18 and rotatable therewith is a rotating vane assembly 20 which includes an essentially circular ,arrangement of uniformly spaced pitched steel vanes 22 through which air is caused to flow upwardly around the periphery of the grinding bowl 18 for the purpose of carrying fines upwardly to a classification area. Vanes 22 are welded to a steel inner ring 24 which is mounted for rotation around bowl 18. Larger particles of ground coal pass downwardly through the vanes 22 into the lower section of the bowl mill 10. The overall construction and operation of a bowl mill type pulverizer is well known and will be apparent to those skilled in the art.

Figure 2:
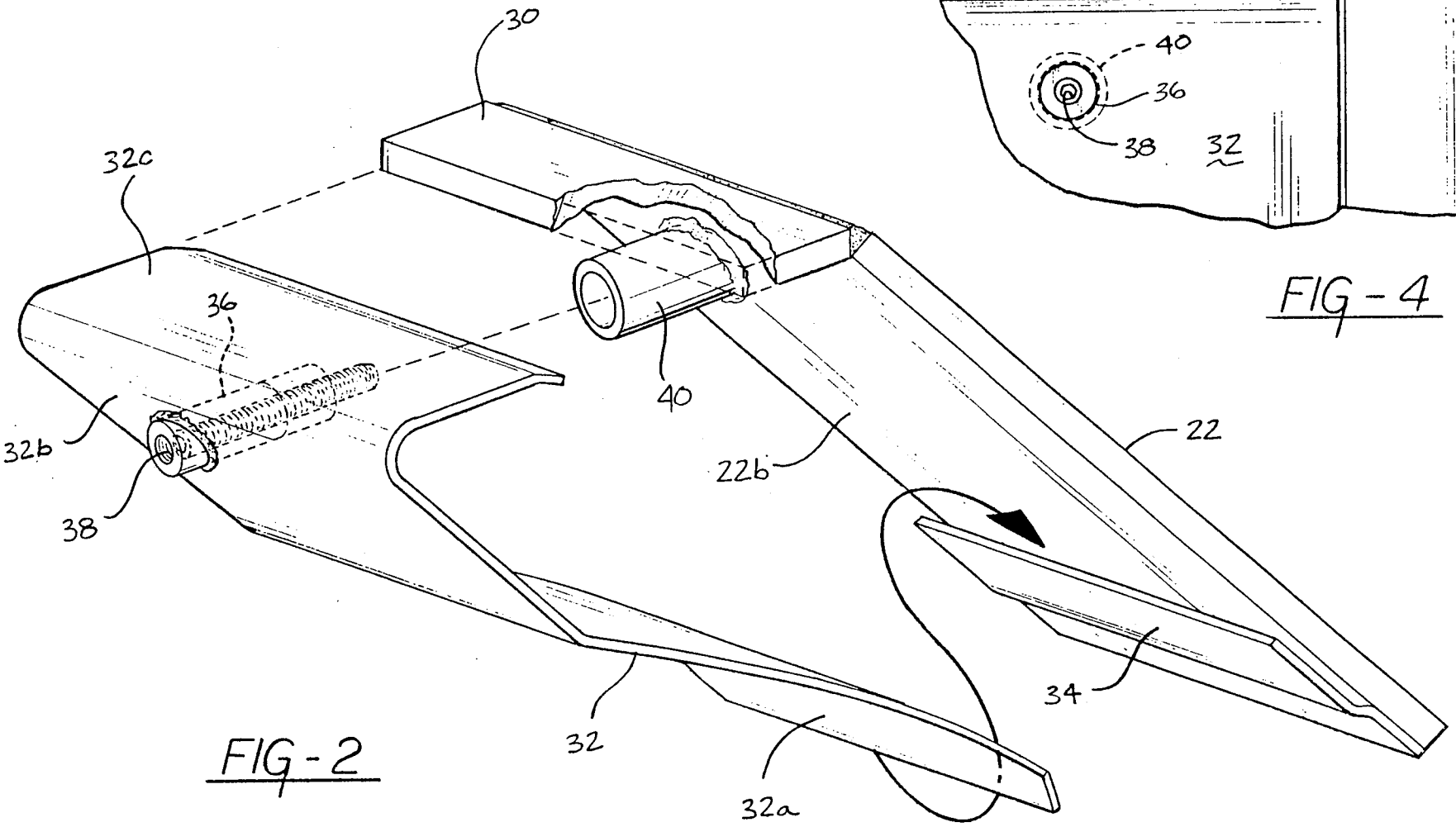
FIG. 2 is an exploded perspective view of components of the air flow rate control device in the pulverizer of FIG. 1.
Figure 5:
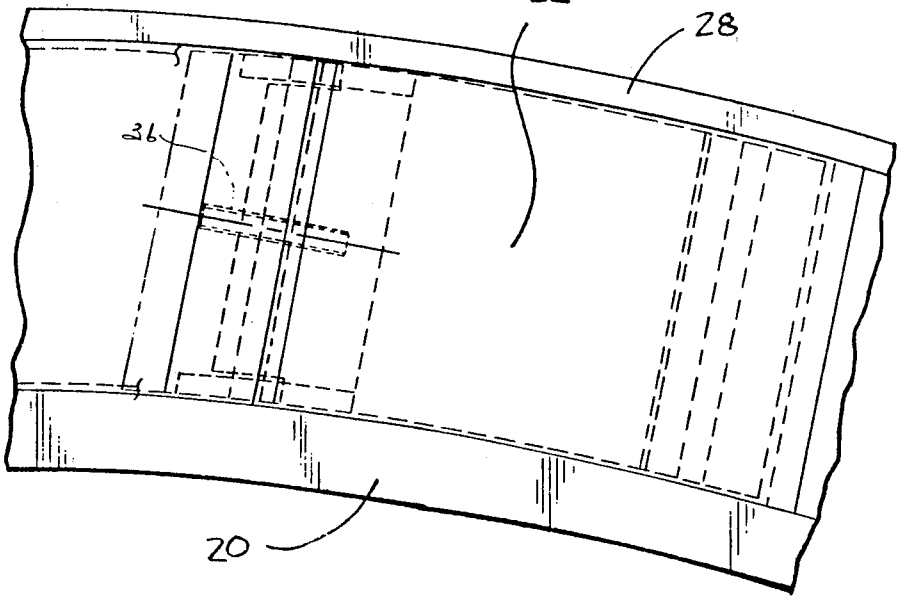
FIG. 5 is a plan view of a portion of the rotating vane assembly of FIG. 1.
Figure 3:
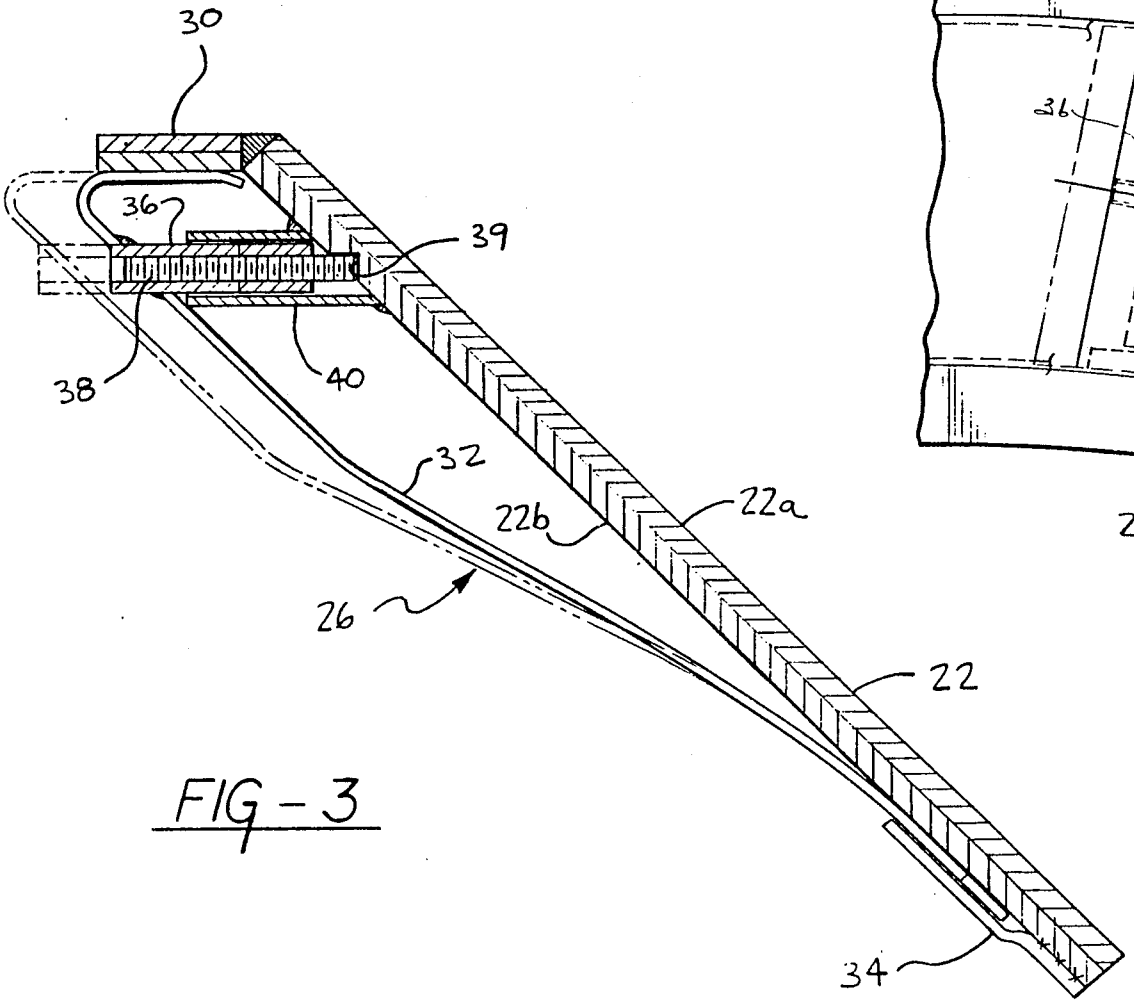
FIG. 3 is a side view of the assembled air flow rate control device.

As best shown in FIGS. 2 and 3, the pitched vanes 22 have major upper and lower major plane surfaces **22*a* and 22*b*. Surface 22*a*, if unprotected, is subject to rapid wear due to the abrasive action of coal particles falling downwardly through the vane arrangement 20 as aforesaid. The lower plane surfaces 22***b*, although exposed to upwardly traveling fines, do not experience significant abrasion and, therefore, need not be protected. To protect the upper surfaces 22*a*, various devices may be used; for example, a layer of high hardness, wear resistant material may be welded to a soft steel plate to form a composite. The liner arrangement disclosed in my prior U.S. Pat. No. 4,907,751, the specification and disclosure of which is incorporated herein by reference, may also be employed. Alternatively, the vane plates may be hardened by heat treating or constructed entirely of high-hardness material.

In accordance with the present invention, air flow control devices 26 are adjustably mounted on the lower surfaces 22*b* of the vanes 22 for the purpose of controlling air flow velocity through the air passages defined by the vanes 22 as hereinafter described.

Referring now to FIGS. 2 through 5, the vanes 22 are shown to comprise rectangular composite steel plates which are welded between inner and outer rings 20 and 28. As represented by the structure of FIG. 1, outer ring 28 is not essential, but is the preferred construction. Smaller top plates 30 are welded to the vanes 22 at an angle to lie in a horizontal plane in the embodiment of FIG. 1. Each of the air flow control devices 26 comprises a deflector in the form of a (relatively light gage) spring steel shape 32 having a lower portion 32*a*, an intermediate planar portion 32*b* and a reversely bent top portion 32*c* which, when the shape 32 is properly installed on the lower surface of the vane 22 as hereinafter described, underlies the small top plate 30 of the vane 22.

As shown in FIGS. 2 and 3 a hinge plate or cup 34 is welded to the lower face of the vane 22 near the bottom to receive and hold the lowermost extremity 32*a* of the shape 32, the degree of overlap being on the order of one-to-two inches to permit a hinge action and a sliding relative motion for purposes hereinafter explained.

A tubular nut 36 having a threaded inner bore is welded to the shape 32 in the intermediate planar portion 32*b* so as to protrude through the shape 32 and lie with its longitudinal axis extending essentially horizontally in the installed condition. An Allen-head bolt 38 is threaded into the tubular nut 36 for purposes hereinafter described.

An unthreaded tube 40 having an internal diameter which is slightly larger than the outside diameter of the tube 36 is bevel cut and welded to the lower surface of the vane 22 adjacent the top thereby to receive in relative sliding engagement the tube nut 36 carrying the Allen-head bolt 38. A pocket 39 is cut into the lower face 22*b* of the vane 22 to receive and provide a stop for the base of the nut 38.

In the assembled condition shown in FIG. 3, the bottom extremity 32*a* of the shape 32 fits into the hinge plate 34, the bolt 38 is threaded into the nut 36 and the nut 36 is disposed into the tube 40 such that the top portion 32*c* of the shape 32 immediately underlies and bears lightly against the lower surface of the minor vane plate 30. The spring action of the steel shape 30 while engaged within the hinge plate 34 serves as a bias to urge the shape 32 toward the lower face of the vane 22 and adjustment of the relative spacing between the shape 32 and the lower surfaces of vane 22 is determined by rotating the threaded bolt 38 in the nut 36. As will be apparent from an examination of the assembly of FIG. 3 urging the bolt 38 farther into the trapped tubular nut 36 displaces the shape 32 away from the lower surface of the vane 22. In the assembled environment of FIG. 1, displacing the shape 32 away from the lower surface of the vane 22 reduces the area in the cross section between vanes 22 and causes a corresponding increase in air flow velocity, assuming a constant air flow pressure head. Moreover, the shape 32 slides slightly upwardly in the hinge plate 34 to accommodate the essentially rectilinear motion which is produced by the particular orientation of the adjustor mechanism including tubes 36 and 40 and nut 38.

It will also be seen in FIG. 3 that the shape of the air flow passage between vanes is essentially that of a venturi; i.e., it is only marginally reduced near the entry of the passage but then becomes gradually smaller as a result of the location of the shape 32 in the passage and the greater degree of spacing between the shape and the vane 22 which occurs toward the top of the passage. Accordingly, air is permitted to accelerate gradually and relatively uniformly toward the top of the air flow passage. As will be apparent to those skilled in the mechanical fabrication arts, the hinge 34 may be constructed in a variety of alternative ways and the adjustment mechanism provided in this case by the tubes 36 and 40 and the Allen-head bolt 38 may also be constructed and implemented in a variety of ways. For example, rotary hinges may be employed where the adjustment mechanism is mounted essentially orthogonally to the vane, this arrangement calling for a variation in the shape of the top of the shape 32 and a filler device beneath the plate 30 at the top of the vane. The shapes 26 may be made from a variety of materials from relatively light gage spring steel to harder, thicker steels and may also be plated, coated or heat treated for increased durability as desired. Many such alternatives, as well as accommodations to differing vane and vane wheel designs, will occur to those skilled in the mechanical arts.

I claim:

1. In a pulverizer of the type which includes an essentially circular arrangement of pitched vanes forming air flow passages there between and having upper and lower plane surfaces, an improvement comprising:

air flow velocity control means comprising means for deflecting air in said air flow passages mounted on the lower plane surfaces of at least some of said vanes.

2. Apparatus as defined in claim 1 wherein means are provided for adjusting the spacing between said means for deflecting means and said lower surfaces.

3. For use with a pulverizer of the type which includes a circular arrangement of pitched vanes forming air passages and having upper and lower-exposed surfaces;

apparatus for adjusting the air flow velocity through said passages comprising:

deflector means mounted on the lower surfaces of respective vanes; and means associated with each of said deflector means for selectively adjusting the spacing thereof relative to the lower surface of the associated vane thereby to adjust the cross-sectional area of at least a portion of the associated passage.

4. Apparatus as defined in claim 3 wherein the adjustment means comprises hinge means for connecting one end of the deflector means to said bottom surface, and manually adjustable means for connecting an opposite end of the deflector means to the bottom surface of the vane, said manually adjustable means being selectively operable to vary the spacing between the vane and said opposite end.

5. Apparatus as defined in claim 4 wherein said manually adjustable means comprises a threaded fastener.

6. Apparatus as defined in claim 4 wherein said hinge means permits relative sliding motion between said one end of the deflector means and the bottom surface of the associated vane.

7. Apparatus as defined in claim 3 wherein the deflector means is a metal plate approximating the width and height of the associated vane.

8. Apparatus as defined in claim 7 wherein said deflector plate further comprises a top portion effectively closing the space between the vane and the deflector and lying essentially in a horizontal plane when in the installed condition.

9. Apparatus as defined in claim 8 wherein the vane effectively comprises a top plate which overlies the top portion of the deflector plate when in the installed condition.

10. Apparatus as defined in claim 4 further including bias means for applying a bias force to the deflector means relative to the associated vane.

11. In combination: a pulverizer throat including a rigid inner support ring and a plurality of pitched rigid vanes secured to and extending radially from said ring at circumferentially uniformly spaced intervals, each of said pitched vanes having parallel planar upper and lower surfaces and forming air passages therebetween; and position-adjustable means disposed on and adjustable relative to the lower surfaces of the pitched vanes for selectively varying the effective area of said air passage.

12. Apparatus as defined in claim 11 wherein said adjustable means comprises a plurality of deflector plates and means for adjustable mounting individual deflector plates on respective lower vane surfaces, said adjustable means being operable to vary the spacing between the deflector and the lower vane surface. plates on respective lower vane surfaces, said adjustable means being operable to vary the spacing between the deflector and the lower vane surface.

13. Apparatus as defined in claim 12 wherein said apparatus further comprises hinge means disposed at a lower extremity of the vane for permitting pivotal motion of the deflector means relative to the vane surface and threaded means connecting the opposite end of the deflector plate to the lower surface of the vane.

14. Apparatus as defined in claim 13 wherein the pulverizer throat is a rotatable vane wheel.

* * * * *

UNITED STATES PATENT AND TRADEMARK OFFICE

CERTIFICATE OF CORRECTION

PATENT NO. : 5,090,631

DATED : February 25, 1992

INVENTOR(S) : Rickey E. Wark

It is certified that error appears in the above-identified patent and that said Letters Patent is hereby corrected as shown below:

Column 2, Line 53, Please delete "circular, arrangement" and insert -- circular arrangement --.

Column 6, Line 14, After surface. Please delete "plates" and lines 15, 16, and 17.

Signed and Sealed this

Thirty-first Day of August, 1993

*Attest:*

*Attesting Officer*

Bruce Lehman

BRUCE LEHMAN

*Commissioner of Patents and Trademarks*